US009277595B2

(12) United States Patent
Myo

(10) Patent No.: US 9,277,595 B2
(45) Date of Patent: Mar. 1, 2016

(54) HEATING LAMP HAVING BASE TO FACILITATE REDUCED AIR FLOW ABOUT THE HEATING LAMP

(71) Applicant: APPLIED MATERIALS, INC., Santa Clara, CA (US)

(72) Inventor: Nyi Oo Myo, San Jose, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 194 days.

(21) Appl. No.: 13/770,013

(22) Filed: Feb. 19, 2013

(65) Prior Publication Data

US 2013/0223824 A1 Aug. 29, 2013

Related U.S. Application Data

(60) Provisional application No. 61/603,215, filed on Feb. 24, 2012.

(51) Int. Cl.
*F26B 3/30* (2006.01)
*F26B 19/00* (2006.01)
*H05B 3/00* (2006.01)

(52) U.S. Cl.
CPC ..... *H05B 3/0047* (2013.01)

(58) Field of Classification Search
USPC ..... 392/411
See application file for complete search history.

(56) References Cited

U.S. PATENT DOCUMENTS 3,761,678 A * 9/1973 Eckles ..... 392/411
3,936,686 A * 2/1976 Moore ..... 313/36
4,841,422 A * 6/1989 Groh ..... 362/294
5,268,613 A * 12/1993 Cunningham ..... 313/113
5,329,436 A * 7/1994 Chiu ..... 362/294
5,420,769 A * 5/1995 Ahlgren et al. ..... 362/294
5,458,505 A * 10/1995 Prager ..... 439/485
5,487,127 A * 1/1996 Gronet et al. ..... 392/416
5,873,650 A * 2/1999 Luk et al. ..... 362/294
6,167,195 A * 12/2000 Moslehi et al. ..... 392/418
6,476,362 B1 * 11/2002 Deacon et al. ..... 219/390
6,744,187 B1 * 6/2004 Wimberly ..... 313/110
6,768,084 B2 * 7/2004 Liu et al. ..... 219/390
7,509,035 B2 * 3/2009 Ranish et al. ..... 392/416
2004/0156625 A1 8/2004 Garmer et al.
2005/0146257 A1 7/2005 Trujillo et al.
2005/0276063 A1 12/2005 Coushaine et al.
2006/0066193 A1 3/2006 Ranish et al.
2006/0249695 A1 11/2006 Choi

OTHER PUBLICATIONS

International Search Report and Written Opinion mailed Jun. 2, 2013 for PCT Application No. PCT/US2013/026645.

* cited by examiner

*Primary Examiner* — Thor Campbell
(74) *Attorney, Agent, or Firm* — Moser Taboada; Alan Taboada

(57) ABSTRACT

Embodiments of heating lamps and heating lamp arrays are disclosed herein. In some embodiments, a heating lamp may include a heating lamp envelope having a filament disposed within the heating lamp envelope; a base coupled to the heating lamp envelope to support the heating lamp envelope; and one or more recesses formed in the base to provide an improved grip for a user. In some embodiments, a heating lamp array for use in a semiconductor process chamber may include a plurality of heating lamps, each heating lamp comprising a heating lamp envelope having a filament disposed within the envelope and a base coupled to the heating lamp envelope to support the envelope, the base having one or more recesses formed in the base to provide an improved grip for a user, wherein a distance between adjacent heating lamp bases is about 0.02 inches to about 0.08 inches.

20 Claims, 5 Drawing Sheets

HEATING LAMP HAVING BASE TO FACILITATE REDUCED AIR FLOW ABOUT THE HEATING LAMP

CROSS-REFERENCE TO RELATED APPLICATIONS

This application claims benefit of U.S. provisional patent application Ser. No. 61/603,215, filed Feb. 24, 2012, which is herein incorporated by reference.

FIELD

Embodiments of the present invention generally relate to semiconductor processing using heat lamps.

BACKGROUND

The inventor has observed that conventional heating lamps utilized in semiconductor process chambers typically have a profile that allows high air flow about the heating lamp. This high air flow allows cooling of the heating lamp components to temperatures sufficiently low to undesirably allow deposition of materials on the heating lamp components. For example, in heating lamps having a filament fabricated from a material such as tungsten (W), the filament material may sublime and deposit on inner surfaces of the heating lamp. By allowing the filament material to deposit on the inner surfaces of the heating lamp (rather than re-depositing on the filament), the filament becomes depleted, thus causing a weakening and leading to possible failure of the filament.

In addition, conventionally utilized heating lamps typically have a base with smooth surfaces. The inventor has observed that such smooth surfaces do not provide an adequate grip to facilitate removal and/or installation of the heating lamp safely. For example, a user's hand may slip from the base and come in contact with hot or electrically charged components of the heating lamp, thereby causing injury.

Therefore, the inventor has provided an improved heating lamp.

SUMMARY

Embodiments of heating lamps and heating lamp arrays for use in, for example, semiconductor substrate processing are disclosed herein. In some embodiments, a heating lamp may include a heating lamp envelope having a filament disposed within the heating lamp envelope; a base coupled to the heating lamp envelope to support the heating lamp envelope; and one or more recesses formed in the base to provide an improved grip for a user. In some embodiments, a heating lamp array for use in a semiconductor process chamber may include a plurality of heating lamps, each heating lamp comprising a heating lamp envelope having a filament disposed within the heating lamp envelope and a base coupled to the heating lamp envelope to support the heating lamp envelope, wherein a distance between adjacent heating lamp bases is about 0.02 inches to about 0.08 inches.

In some embodiments, a heating lamp array for use in a semiconductor process chamber may include: a plurality of heating lamps, each heating lamp comprising a heating lamp envelope having a filament disposed within the heating lamp envelope and a base coupled to the heating lamp envelope to support the heating lamp envelope, the base having one or more recesses formed in the base to provide an improved grip for a user, wherein a distance between adjacent heating lamp bases is about 0.02 inches to about 0.08 inches.

In some embodiments, a process chamber may include: a chamber body; and a heating array disposed within the chamber body, the heating array comprising a plurality of sockets disposed in a circular array and a plurality of heating lamps respectively coupled to the plurality of sockets, wherein each of the plurality of heating lamps comprises heating lamp envelope having a filament disposed within the heating lamp envelope and a base coupled to the heating lamp envelope to support the heating lamp envelope, the base having one or more recesses formed in the base to provide an improved grip for a user and a plurality of fins disposed on, and extending from, at least a portion of one or more sides of the base, wherein a distance between adjacent heating lamp bases is about 0.02 inches to about 0.08 inches.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
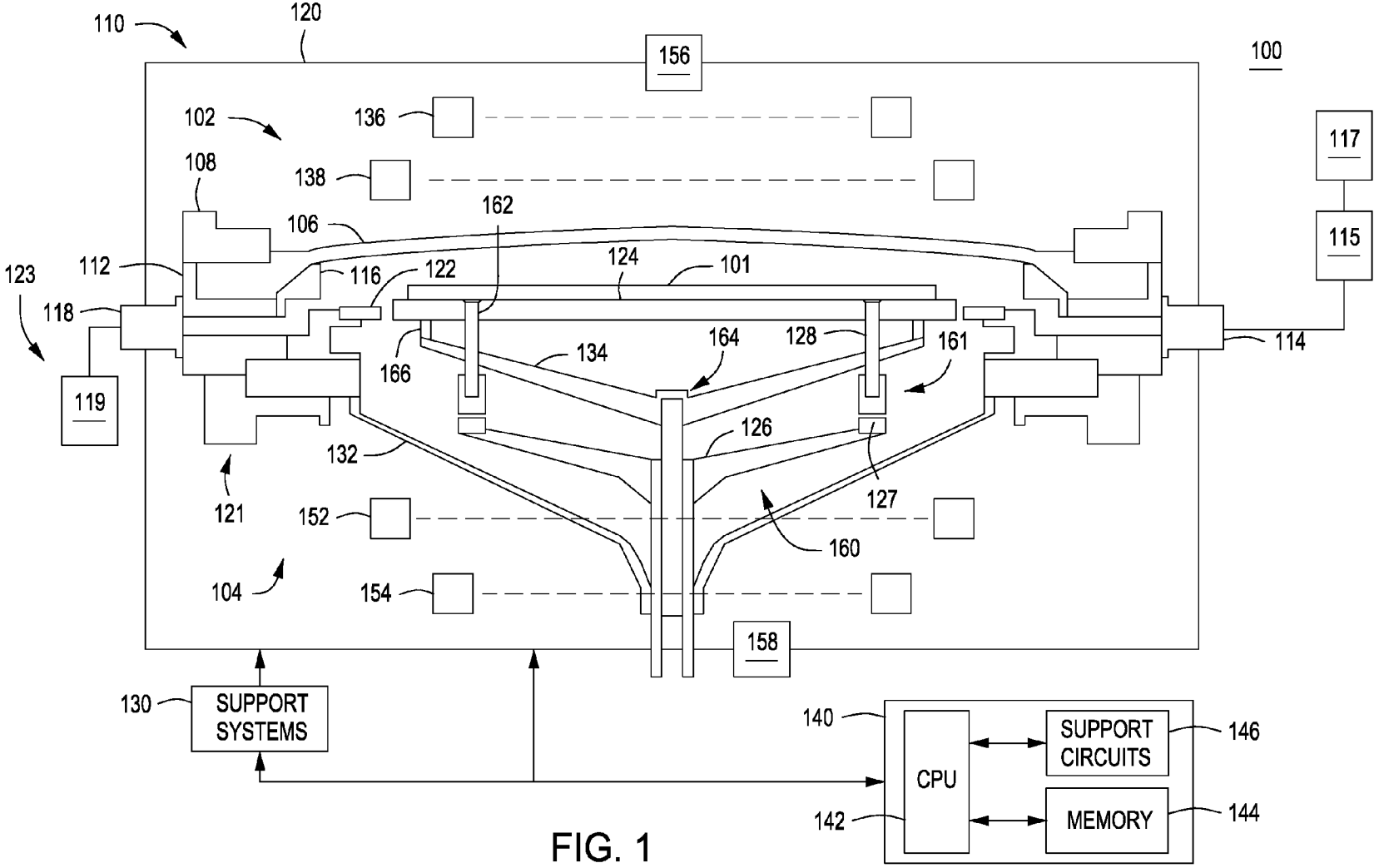
FIG. 1 is a process chamber suitable for use with a heating lamp in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of heating lamps having heating lamp bases that may facilitate reduced air flow as compared to conventional heating lamps are disclosed herein. Embodiments of the present invention may advantageously provide heating lamps having an extended useful life as compared to conventional heating lamps. The inventive heating lamp may further advantageously provide a gripping surface for a user to facilitate installation and/or removal of the heating lamp, thereby reducing the risk of injury to the user during installation and/or removal of the heating lamp.

FIG. 1 depicts a schematic side view of a process chamber 100 suitable for use with heating lamps in accordance with some embodiments of the present invention. In some embodiments, the process chamber 100 may be a commercially available process chamber, such as any of the EPI®, reactors, available from Applied Materials, Inc. of Santa Clara, Calif., or any suitable semiconductor process chamber that may use heating lamps as described herein. Other process chambers that use heating lamps may also benefit from the teachings provided herein.

The process chamber 100 may generally comprise a chamber body 110, support systems 130, and a controller 140. The chamber body 110 generally includes an upper portion 102, a lower portion 104, and an enclosure 120. A vacuum system 123 may be coupled to the chamber body 110 to facilitate maintaining a desired pressure within the chamber body 110. In some embodiments, the vacuum system 123 may comprise a throttle valve (not shown) and vacuum pump 119 which are used to exhaust the chamber body 110. In some embodiments, the pressure inside the chamber body 110 may be regulated by adjusting the throttle valve and/or vacuum pump 119.

The upper portion 102 is disposed on the lower portion 104 and includes a lid 106, a clamp ring 108, a liner 116, a baseplate 112, one or more upper heating lamps 136 and one or more lower heating lamps 138, and an upper pyrometer 156. In some embodiments, the lid 106 has a dome-like form factor, however, lids having other form factors (e.g., flat or reverse curve lids) are also contemplated.

The lower portion 104 is coupled to a process gas intake port 114 and an exhaust port 118 and comprises a baseplate assembly 121, a lower dome 132, a substrate support 124, a pre-heat ring 122, a substrate lift assembly 160, a substrate support assembly 164, one or more upper heating lamps 152 and one or more lower heating lamps 154, and a lower pyrometer 158. Although the term "ring" is used to describe certain components of the process chamber 100, such as the pre-heat ring 122, it is contemplated that the shape of these components need not be circular and may include any shape, including but not limited to, rectangles, polygons, ovals, and the like. In some embodiments, a gas supply 117 may provide one or more process gases to the process chamber 100 via the inlet 114. In such embodiments, a valve or mass flow controller 115 may be coupled to the gas supply 117 to control a flow of process gases from the gas supply 117.

During processing, the substrate 101 is disposed on the substrate support 124. The heating lamps 136, 138, 152, and 154 are sources of infrared (IR) radiation (e.g., heat) and, in operation, generate a pre-determined temperature distribution across the substrate 101. The heating lamps 136, 138, 152, and 154 may be any type of heating lamps suitable for semiconductor processing, for example, such as 2 kW lamps, 3 kW lamps, or the like. The lid 106, the clamp ring 108, and the lower dome 132 are formed from quartz; however, other IR-transparent and process compatible materials may also be used to form these components.

The substrate support assembly 164 generally includes a support bracket 134 having a plurality of support pins 166 coupled to the substrate support 124. The substrate lift assembly 160 comprises a substrate lift shaft 126 and a plurality of lift pin modules 161 selectively resting on respective pads 127 of the substrate lift shaft 126. In some embodiments, the lift pin 128 is movably disposed through a first opening 162 in the substrate support 124. In operation, the substrate lift shaft 126 is moved to engage the lift pins 128. When engaged, the lift pins 128 may raise the substrate 101 above the substrate support 124 or lower the substrate 101 onto the substrate support 124.

The support systems 130 include components used to execute and monitor pre-determined processes (e.g., growing epitaxial films) in the process chamber 100. Such components generally include various sub-systems. (e.g., gas panel(s), gas distribution conduits, vacuum and exhaust sub-systems, and the like) and devices (e.g., power supplies, process control instruments, and the like) of the process chamber 100. These components are well known to those skilled in the art and are omitted from the drawings for clarity.

The controller 140 may be provided and coupled to the process chamber 100 for controlling the components of the process chamber 100. The controller 140 may be any suitable controller for controlling the operation of a substrate process chamber. The controller 140 generally comprises a Central Processing Unit (CPU) 142, a memory 144, and support circuits 146 and is coupled to and controls the process chamber 100 and support systems 130, directly (as shown in FIG. 1) or, alternatively, via computers (or controllers) associated with the process chamber and/or the support systems.

The CPU 142 may be any form of a general purpose computer processor that can be used in an industrial setting. The support circuits 146 are coupled to the CPU 142 and may comprise cache, clock circuits, input/output subsystems, power supplies, and the like. Software routines, such as the methods for processing substrates disclosed herein, for example with respect to FIG. 2 below, may be stored in the memory 144 of the controller 140. The software routines, when executed by the CPU 142, transform the CPU 142 into a specific purpose computer (controller) 140. The software routines may also be stored and/or executed by a second controller (not shown) that is located remotely from the controller 140. Alternatively or in combination, in some embodiments, for example where the process chamber 100 is part of a multi-chamber processing system, each process chamber of the multi-chamber processing system may have its own controller for controlling portions of the inventive methods disclosed herein that may be performed in that particular process chamber. In such embodiments, the individual controllers may be configured similar to the controller 140 and may be coupled to the controller 140 to synchronize operation of the process chamber 100.

Figure 2:
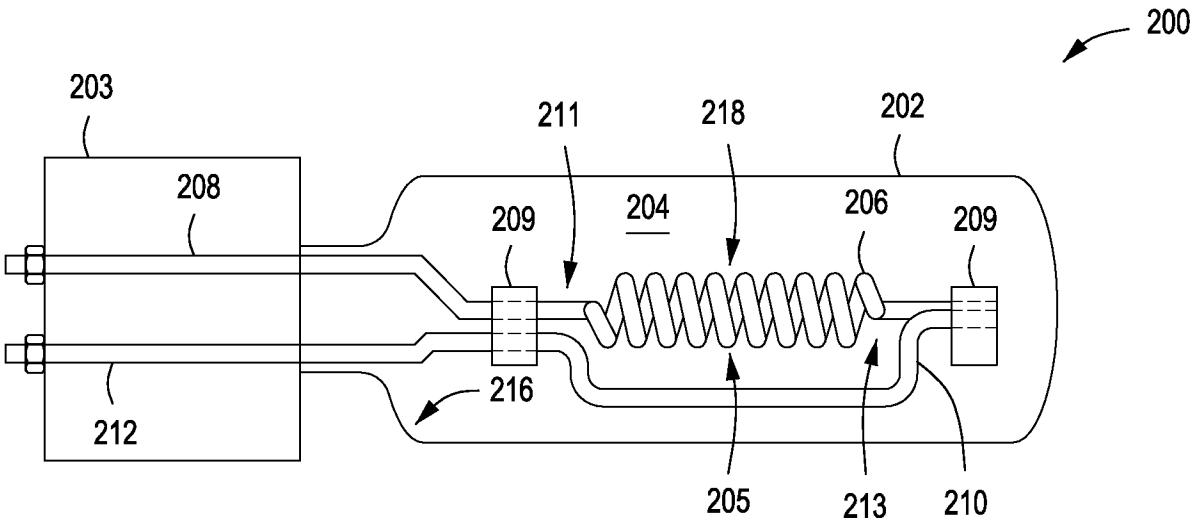
FIG. 2 is a heating lamp in accordance with some embodiments of the present invention.

Referring to FIG. 2, in some embodiments, a heating lamp 200 (e.g., any of the heating lamps 136, 138, 152, 154 described above) may generally comprise a lamp envelope 202 having interior volume 204. The lamp envelope 202 may be formed of a transparent or semi-transparent material, such as quartz, glass, or other suitable materials.

A filament 206 is disposed within the interior volume 204 to provide heat energy when electric current is provided to the filament 206 of the heating lamp 200. The filament 206 includes a main body 205 disposed between a first end 211 and a second end 213 of the filament 206. The filament 206 is coupled at the first end 211 to a first conductor 208. In some embodiments, the filament 206 may be supported by one or more support structures (not shown) which extend from one or more support bases 209 disposed within the interior volume 204. In some embodiments, a conductive first interceptor bar 210 may be disposed within the lamp envelope 202 beneath the filament 206. As used, herein, beneath means both directly beneath or at an angle to (e.g., below and to a side of) the filament 206, so long as the filament may contact the conductive first interceptor bar 210 when sagging to a sufficient degree during use or over time. The first interceptor bar 210 may be coupled between the second end 213 of the filament 206 and a second conductor 212. During typical operation, current flows into the lamp via the first conductor 208, through the filament 206, along the first interceptor bar 210, and exits the lamp via the second conductor 212.

In some embodiments, the filament 206 comprises a tightly coiled wire that is then wrapped into a plurality of coils 218. The plurality of coils 218 may form the main body 205 of the filament 206. However, other configurations of the filament are possible, such as loops, helices, or other suitable coil-like configurations. The increased length, and current path, of the filament, for example, by providing coils 218 and secondary coils (not shown), can increase resistance through the filament 106, which can allow the lamp to operate at lower currents. The filament may be formed of tungsten (W) or another suitable filament material.

In some embodiments, the interior volume 204 may be filled with an inert gas, for example, argon, helium, or the like, and further with a halogen gas, such as bromine or hydrogen bromide. When present, during use of the heating lamp 200, the halogen gas may prevent deposition of the filament material on interior surfaces 216 of the heating lamp envelope 202 by facilitating re-deposition of the filament material on the filament 206.

The heating lamp 200 may further include a base 203 having the first and second conductors 208, 212 disposed therethrough. The base 203 may provide support to the lamp 200, such as by being held in a socket assembly (described below) or other similar structure. The base may be fabricated from any non-conductive material suitable to provide support to the lamp, for example a ceramic such as aluminum oxide ($Al_2O_3$) or the like.

Figure 3:
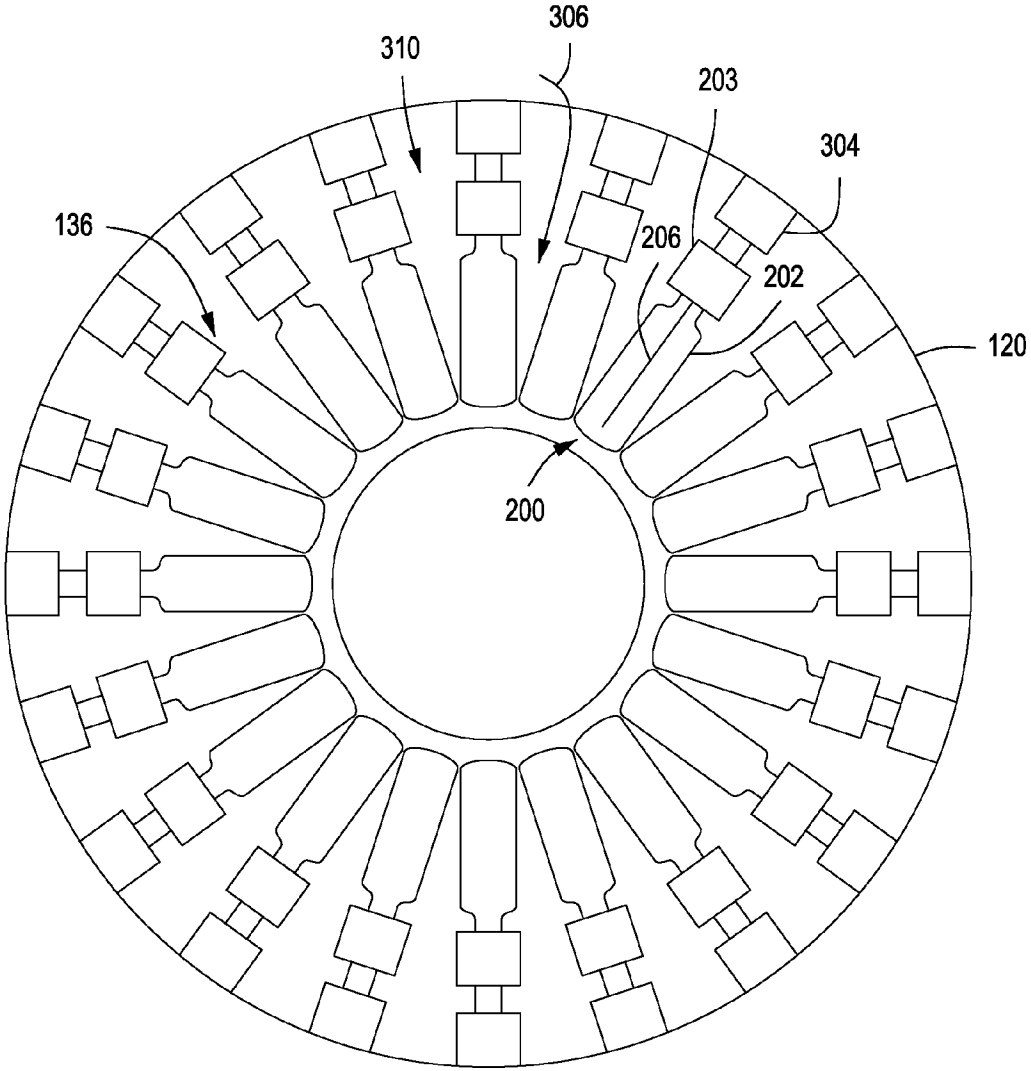
FIG. 3 is an array of heating lamps suitable for use with a process chamber in accordance with some embodiments of the present invention.

In some embodiments, one or more heating lamps (e.g., heating lamps 136, 138, 152, 154 described above) may be arranged or configured in any manner suitable to provide a desired temperature profile within a process chamber (e.g., process chamber 100 described above) to facilitate a process within the process chamber. For example, in some embodiments, one or more of a group of the upper heating lamps 136, 138 or the lower heating lamps 152, 154 (upper heating lamps 136 shown) may be arranged in an array, for example, such as the circular array as depicted in FIG. 3. In such embodiments, each heating lamp 200 of the group of heating lamps 136 may be coupled to a respective socket 304 to provide power to the heating lamp 200. The socket 304 may be supported by, or coupled to, any portion of the process chamber, for example such as the enclosure 120 described above, or in any other suitable location to position the lamps as desired to facilitate providing the heat energy from the lamps to the process chamber during use.

The inventor has observed that during use of the heating lamps 200, an air flow (shown by arrow 306) around the heating lamps 200 may cause a cooling of the heating lamp envelope 202. The inventor has further observed that due to the size of a gap 310 between adjacent conventional heating lamps, the amount of air flow may undesirably cool the heating lamp envelope 202 to a temperature sufficient to allow deposition of materials within the heating lamp envelope 202. For example, in embodiments where the heating lamp comprises a filament 206 fabricated from a material such as tungsten (W), the filament material may sublime and deposit on the heating lamp envelope 202. In addition, in embodiments where a halogen gas, for example such as a bromine (Br) or hydrogen bromide (HBr), is supplied to the lamp envelope 202 to facilitate re-deposition of the sublimed filament material back onto the filament 206, the halogen gas may deposit on the heating lamp envelope 202. By depositing on the heating lamp envelope 202, the halogen gas is not available to facilitate re-deposition of the sublimed filament material back onto the filament 206, thereby further allowing the filament material to deposit on the heating lamp envelope 202. By allowing the filament material to deposit on the lamp envelope 202 rather than re-depositing on the filament 206, the filament 206 becomes depleted, thus causing a weakening and possible failure of the filament 206.

Accordingly, in some embodiments, the base 203 may have sufficient dimensions to "choke" (i.e., limit) the air flow 306 between adjacent heating lamps 200. For example, the inventors have discovered that the air flow may be sufficiently limited by configuring the lamps to have a base size such that, when disposed in the array, the minimum distance between adjacent bases of the lamps is about 0.02 inches (or about 0.50 mm) to about 0.08 inches (or about 2 mm), or, in some embodiments, about 0.03 inches (or about 0.76 mm). By limiting the air flow 306 between the adjacent heating lamps 200, the heating lamp envelope 202 of the heating lamps 200 may advantageously be maintained at a higher temperature, thereby preventing deposition of the filament materials and/or halogen gases onto the heating lamp envelope 202, thus allowing an increased re-deposition of the filament materials onto the filament 206. By allowing the increased re-deposition of the filament materials onto the filament 206, the inventor has observed that the rate of depletion of the filament may be decreased, thereby reducing or eliminating failure of the filament 206 due to the depletion effect and extending the useful life of the filament 206.

Figure 4:
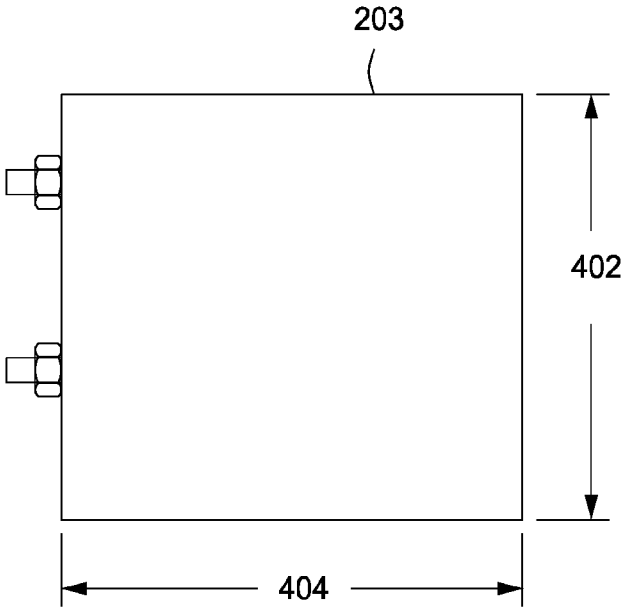
FIGS. 4-7 are various views of a base suitable for use with a heating lamp in accordance with some embodiments of the present invention.
Figure 5:
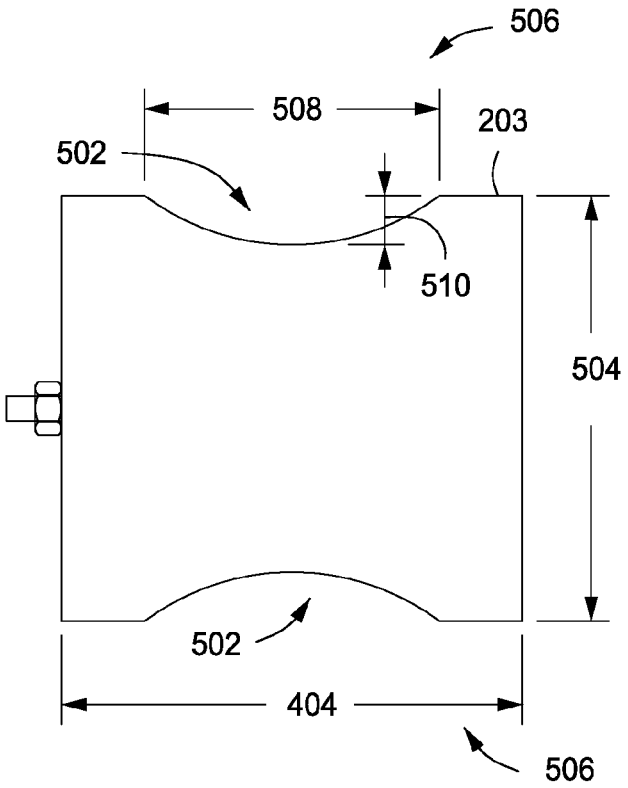

The base 203 may have any dimensions suitable to limit the air flow 306 between adjacent heating lamps 200. For example, in some embodiments, the base may have a width 402 of about 43 to about 45 mm, as shown in FIG. 4. In some embodiments, the base 203 may have a length 404 of about 25 to about 28 mm. Referring to FIG. 5, in some embodiments, the base may have a thickness 504 of about 43 to about 46 mm.

The inventor has further observed that in conventionally utilized heating lamps, components of the heating lamps, for example such as the base, have smooth surfaces. The inventor has observed that such smooth surfaces do not provide an adequate gripping surface, for example, to facilitate manual installation and/or removal of the heating lamp, which may undesirably lead to a user's hand slipping from the base and coming into contact with a hot surface (e.g., the heating lamp envelope), thereby causing an injury, or damaging the lamp. Accordingly, in some embodiments, the base 203 may include one or more recesses (two recesses 502 shown) configured to provide an improved grip for a user, such as shown in FIG. 5. By providing the one or more recesses 502, an adequate gripping surface is provided to the user, thereby reducing the risk of injury to the user or to the lamp caused by the user's hand slipping from the base and making contact with an electrically charged or hot component of the heating lamp.

In some embodiments, the one or more recesses 502 may consist of two recesses 502 disposed on opposing sides 506 of the base 203 (although greater of fewer recessed 502 may be provided). The recesses 502 may be positioned in any manner suitable to facilitate improving grip of the lamp by a user to allow installation or removal of the heating lamp. For example, in some embodiments, the recesses 502 may be positioned disposed centrally along the width of the base 203. In some embodiments, the recesses may be a concave curved portion of the base 203, such as is formed by the intersection of a portion of a sidewall of a cylinder with the base 203. In some embodiments, the recesses each have a linear axis that are parallel with each other and substantially perpendicular to a primary axis of the lamp (e.g., running from the base to the tip of the envelope). In some embodiments, the recesses may be a pair of concave recesses, or channels, disposed on opposite sides of the base 203

The recesses 502 may have any dimensions suitable to provide the aforementioned grip. For example, in some embodiment, each recess 502 may have a width 508 of about 10 to about 15 mm. In some embodiments, the recess may have a depth 510 of about 0.3 to about 1 mm.

Figure 6:
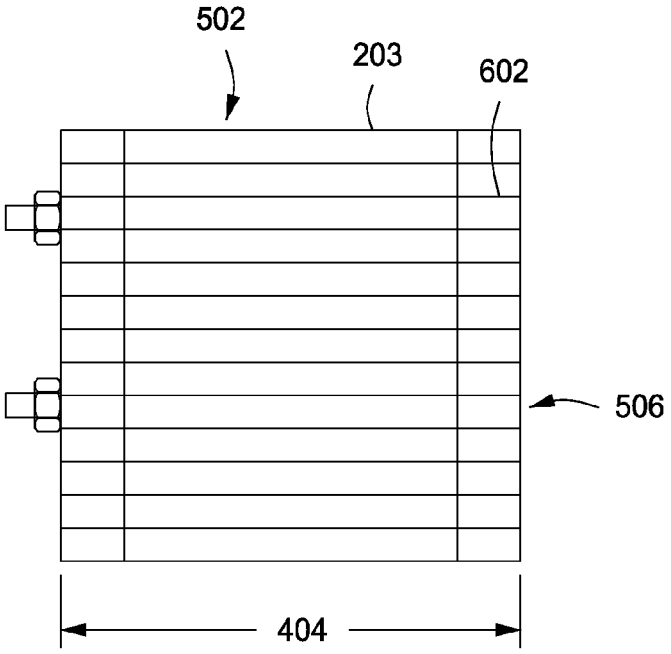
Figure 7:
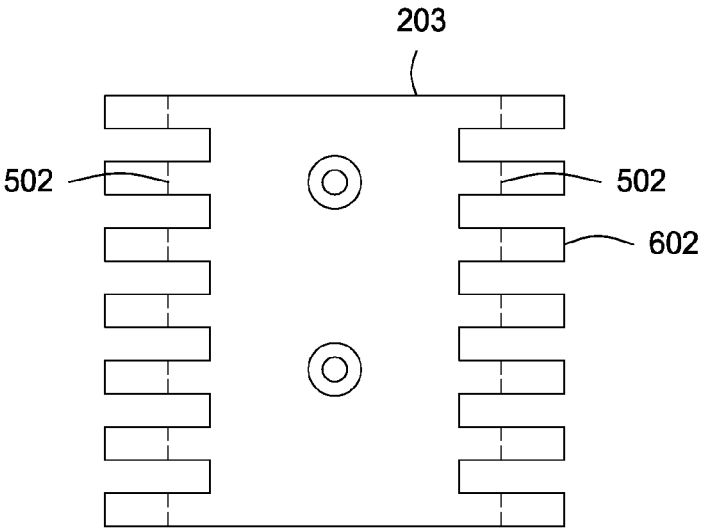

In any of the above embodiments, the base 203 may comprise a plurality of fins 602 disposed on and extending from the sides 506 of the base 203, for example such as shown in FIGS. 6 and 7. The inventor has observed that by providing the plurality of fins 602, the air flow between adjacent heating lamps (e.g., as described above) may be further reduced, thereby further allowing the heating lamps to be maintained at a higher temperature, thereby further preventing deposition of the filament materials and/or halogen gases onto the heating lamp envelope, and allowing an increased re-deposition of the filament materials onto the filament. The plurality of fins 602 may also further enhance the grip of a user when handling the lamp 200. The plurality of fins 602 may be configured in any manner suitable to provide the above described reduction in air flow. For example, in some embodiments the plurality of fins 602 may be disposed along the entire length 404 of the base 203. Alternatively, in some embodiments, the plurality of fins 602 may be shorter than the length 404 of the base 203. For example, in some embodiments, the plurality of fins 602 may be provided at least along the one or more recesses 502. In some embodiments, the plurality of fins 602 may be extend from a first end of the base 203 proximate the heating lamp envelope 202 to a point beyond the one or more recesses 502, but terminating prior to reaching an opposite second end of the base 203. The plurality of fins 602 may have any dimensions suitable to provide the above described reduced air flow.

Thus, an improved heating lamp has been disclosed herein. The inventive heating lamp includes a heating lamp base that may advantageously provide sufficient dimensions to "choke" (i.e., limit) the air flow around the heating lamps. By limiting the air flow, the heating lamp envelope may be maintained at a higher temperature, thereby preventing deposition of the filament materials and/or halogen gases onto the heating lamp envelope, thus allowing an increased re-deposition of the filament materials onto the filament. Allowing an increased re-deposition of the filament materials onto the filament may prevent premature weakening or failure of the filament, thus extending the useful life of the heating lamp. The inventive heating lamp may further include one or more recesses in the base configured to provide an improved gripping surface for a user to facilitate installation and/or removal of the heating lamp. By providing an adequate gripping surface the possibility of injury to the user caused by the user's hand slipping from the base and making contact with an electrically charged or hot component of the heating lamp may be reduced or eliminated.

While the foregoing is directed to embodiments of the present invention, other and further embodiments of the invention may be devised without departing from the basic scope thereof.

The invention claimed is:

1. A heating lamp for use in a semiconductor process chamber, comprising:

a heating lamp envelope having a filament disposed within the heating lamp envelope;

a base having a first surface from which the heating lamp envelope is cantilevered, a second surface parallel to and opposing the first surface, and two third surfaces that are parallel to and oppose each other, the two third surfaces extending between the first surface and the second surface; and one or more recesses extending into the two third surfaces to provide an improved grip for a user, wherein the one or more recesses have linear axes that are parallel with each other and substantially perpendicular to a primary axis of the heating lamp envelope.

2. The heating lamp of claim 1, wherein the one or more recesses are two recesses disposed on opposing sides of the base.

3. The heating lamp of claim 1, wherein the one or more recesses are disposed centrally along the width of the base.

4. The heating lamp of claim 1, wherein the one or more recesses have a width of about 10 to about 15 mm and a depth of about 0.3 to about 1 mm.

5. The heating lamp of claim 1, wherein the base has a width of about 43 to about 45 mm, a length of about 25 to about 28 mm, and a thickness of about 43 to about 46 mm.

6. The heating lamp of claim 1, wherein the base comprises a plurality of fins disposed on, and extending from, at least a portion of one or more sides of the base.

7. The heating lamp of claim 6, wherein the recesses are disposed at least partially in at least some of the fins.

8. The heating lamp of claim 1, wherein the base is fabricated from aluminum oxide ($Al_2O_3$).

9. The heating lamp of claim 1, wherein the one or more recesses are two recesses formed on opposite sides of the base, wherein the two recesses have respective linear axes that are parallel with each other and substantially perpendicular to a primary axis of the heating lamp extending from the base to a tip of the heating lamp envelope.

10. A heating lamp array for use in a semiconductor process chamber, comprising:

a plurality of heating lamps, each heating lamp comprising a heating lamp envelope having a filament disposed within the heating lamp envelope and a base coupled to the heating lamp envelope to support the heating lamp envelope, the base having one or more recesses formed in the base to provide an improved grip for a user, wherein a distance between adjacent heating lamp bases is about 0.02 inches to about 0.08 inches to create a choked air flow between the adjacent heating lamp bases, wherein the heating lamp array is circular and each heating lamp envelope extends radially inward.

11. The heating lamp array of claim 10, further comprising a plurality of sockets disposed in a circular array, wherein respective ones of the plurality of heating lamps are coupled to corresponding ones of the plurality of sockets.

12. The heating lamp array of claim 10, wherein the one or more recesses are two recesses formed on opposite sides of the base, wherein the two recesses have respective linear axes that are parallel with each other and substantially perpendicular to a primary axis of the heating lamp extending from the base to a tip of the heating lamp envelope.

13. The heating lamp array of claim 10, wherein the one or more recesses are two recesses disposed on opposing sides of the base.

14. The heating lamp array of claim 10, wherein the one or more recesses are disposed centrally along the width of the base.

15. The heating lamp array of claim 10, wherein the one or more recesses have a width of about 10 to about 15 mm and a depth of about 0.3 to about 1 mm.

16. The heating lamp array of claim 10, wherein the base has a width of about 43 to about 45 mm, a length of about 25 to about 28 mm and a thickness of about 43 to about 46 mm.

17. The heating lamp array of claim 10, wherein the base comprises a plurality of fins disposed on, and extending from, at least a portion of one or more sides of the base.

18. The heating lamp array of claim 17, wherein the recesses are disposed at least partially in at least some of the fins.

19. The heating lamp array of claim 10, wherein the base is fabricated from aluminum oxide ($Al_2O_3$).

20. A process chamber, comprising:

a chamber body; and a circular heating lamp array disposed within the chamber body, the heating lamp array comprising a plurality of sockets disposed in a circular array and a plurality of heating lamps respectively coupled to the plurality of sockets, wherein each of the plurality of heating lamps comprises heating lamp envelope having a filament disposed within the heating lamp envelope and a base coupled to the heating lamp envelope to support the heating lamp envelope, the base having one or more recesses formed in the base to provide an improved grip for a user and a plurality of fins disposed on, and extending from, at least a portion of one or more sides of the base, wherein a distance between adjacent heating lamp bases is about 0.02 inches to about 0.08 inches to create a choked air flow between the adjacent heating lamp bases, wherein each heating lamp envelope extends radially inward.

* * * * *